United States Patent [19]

Arasmith

[11] Patent Number: 4,874,024

[45] Date of Patent: Oct. 17, 1989

[54] WOOD PROCESSING DEVICE HAVING SELF-REVERSING FEATURE

[76] Inventor: Stanley Arasmith, P. O. Box 2458, Rome, Ga. 31064

[21] Appl. No.: 278,737

[22] Filed: Dec. 2, 1988

Related U.S. Application Data

[62] Division of Ser. No. 124,043, Nov. 23, 1987, Pat. No. 4,802,631, which is a division of Ser. No. 917,855, Oct. 14, 1986, Pat. No. 4,776,375.

[51] Int. Cl.[4] ..... B27B 1/00; B77C 1/00

[52] U.S. Cl. ..... 144/174; 144/370; 144/208 G; 241/294; 241/35

[58] Field of Search ..... 144/162 R, 172, 174, 144/176, 208 R, 208 E, 370, 230; 241/278 R, 294, 35

[56] References Cited

U.S. PATENT DOCUMENTS 1,871,499 8/1932 Crago ..... 241/35

4,444,234 4/1984 Arasmith ..... 144/370

*Primary Examiner*—W. Donald Bray

*Attorney, Agent, or Firm*—Jones, Askew & Lunsford

[57] ABSTRACT

A wood cutting knife is provided for producing wood chips or flakes. The knife includes a central cutting member, and two wing members positioned on opposite sides of the central cutting member. The height of the wing members determines the depth of cut of the cutting knife, including the central cutting member. Also provided is a wood processing machine for supporting such cutting knives which includes a plurality of anvil members configured to interact intimately with the cutting knives. Also provided is a breakaway feature between the cutting members and a supporting surface defined by the wood processing machine. The supporting surface is relatively smooth, and the cutting knives are mounted to the surface by weldments. If a cutting knife encounters unprocessable foreign material such as metal or rock, the knife breaks away from the supporting surface at the weldment connection, and severe damage to the supporting surface or machine is avoided. Also provided is a separating grate configured to allow wood chips or flakes which have been sufficiently reduced in size to pass from the machine. The grate may be configured to accept a plurality of stationary knives which interact with the previously-referenced cutting knives to aid in processing of the wood. The stationary knives may include a breakup ledge configured to prevent excessively long wood members from passing through the grate.

2 Claims, 5 Drawing Sheets

WOOD PROCESSING DEVICE HAVING SELF-REVERSING FEATURE

This application is a division of serial No. 124,043, now U.S. Pat. No. 4,802,631, which is a division of serial No. 917,855, now U.S. Pat. No. 4,776,375.

TECHNICAL FIELD

The present invention relates to the processing of wood, usually in the form of logs or brush, and more particularly relates to an improved apparatus which allows for efficient reduction of the wood into wood chips or flakes.

BACKGROUND ART

In known wood processing machines used to convert logs into chips or flakes, it has been common for the machines to include one or more cutting members mounted either on the face of a rotating disc or on the circumferential surface of a rotating drum. During operation of the machines, wood members are guided or urged into the rotating disc or drum so that the knife-like cutting members cut away chips or flakes from the wood members, and the wood members are ultimately consumed.

Such prior art cutting members are typically configured to cut a rectangular or similar cross section in the wood members. However, many of these configurations do not allow for efficient cutting of the wood, as they require large surges of power during the cutting stage, which necessitates the use of large motors. Therefore such prior art devices tend to be large, heavy, and expensive.

Prior art devices also typically utilize cutting members which are partially recessed within the disc or drum. Although this configuration results in a structurally effective attachment between the cutting members and the disc or drum, it is disadvantageous if unprocessable foreign material is present with the wood. When such foreign material is encountered, prior art machines typically jam, and the risk of extensive and costly damage to the machine is high. One example of such recessed cutter mounting configurations is shown in applicant's U.S. Pat. No. 4,444,234 incorporated herein by reference, which discloses the use of a drum having a plurality of the knives mounted within recesses in a rotating drum.

The presence of unprocessable material is a particular problem in processing stumps, brush and other material of the kind remaining on the site or a logging operation. Wood "hogs" used to shred such material are subject to considerable down time and damage to cutting elements when the latter encounter rocks, metal or the like Cutting members in the past have been expensive to manufacture and sharpen, and have been re-sharpened for additional use. Significant expenditures of time and money have been necessary to remove the cutting members, sharpen all their edges, and reinstall them into the machine An example of such resharpenable cutting members is shown in applicant's U.S. Pat. No. 4,569,380, incorporated herein by reference, which discloses the use of a cutting element having a plurality of resharpenable cutting elements.

It has also been known to provide such wood processing machines with separating grates, which allow the passage of adequately-reduced wood chips out of the machine, but direct inadequately-reduced chips back to the input hopper to be processed further These separating grates are typically formed out of a platelike material which defines a plurality of selectively-sized slots. Although these configurations are effective to a degree, they are prone to wear, which is disadvantageous in that the grate is typically of unitary construction, and replacement of the entire grate may be necessary in the case of an excessively worn grate Finally, such prior art separating grates have limited effectiveness when processing wood which has a tendency to break up into elongate splinters, as such splinters may pass through the slots although their length is unacceptable.

Therefore it may be seen that a need has existed in the wood processing art for a cutting member which facilitates power-efficient cutting and shredding of wood products It may also be seen that a need has existed for a wood processing machine which is subject to a minimum of damage when encountering unprocessable foreign material, and has disposable cutting members that can be replaced with a minimum of time and effort. Furthermore, a need has existed for a chip separating grate to be used in such wood processing machines which is resistant to wear, and does not allow the passage of wood chips having an unacceptable length.

SUMMARY OF THE INVENTION

The present invention provides a cutting member which facilitates power-efficient cutting and shredding of wood products. The present invention also provides a wood processing machine which is subject to a minimum of damage when encountering unprocessable foreign material. Finally, the present invention provides a chip filtering grate which provides improved processing and filtering.

Generally described, the present invention provides a cutting element extending above a mounting surface, comprising a first cutting edge positioned a first distance above the surface, and a second cutting edge positioned laterally adjacent to the first cutting edge at a second distance above the surface less than or equal to one half the first distance.

Although a cutting element or "hammer" embodying the present invention can be used advantageously in many wood processing operations, such a hammer is particularly effective when used on a wood processing apparatus which also forms part of the present invention. Generally described, the wood processing apparatus comprises a cutting element for removing wood from a wooden member, a surface for supporting the cutting element means for creating relative movement between the surface and the wooden member, and breakaway connecting means for positioning the cutting element on the surface, the breakaway connecting means releasing the cutting element from the surface responsive to a predetermined resistance being encountered by the cutting element.

Furthermore, the present invention provides a wood chip filtering grate which forms part of the present invention and which may be used with the wood processing machine This configuration comprises a separating grate having a first and a second side, and defining at least one filtering slot of selected size, the filtering slot including a leading and a trailing edge, means for transporting wood members along a path defined by the first side of the grate, such that the wood members are first directed over the leading edge of the slot and thereafter toward the trailing edge of the slot, means defining at least one cutting edge extending from the trailing edge of the slot, such that the cutting edge engages the wood members, and the wood members are processed to a size sufficient to pass through the slot.

The filtering grate may also include a breakup feature which discourages the passage of excessively long "splinters" of wood through the grate. Such a configuration comprises a separating grate having a first and a second side, and defining at least one filtering slot, the filtering slot including a leading edge and a trailing wall, means for transporting wood chips along a path defined by the first side of the grate, such that the wood members are first directed over the leading edge of the slot and thereafter into the slot, and a ledge extending into the slot from the trailing wall for engaging the wood chips such that the wood chips engage the ledge and are further reduced by breakage.

Finally, the wood processing apparatus of present invention may also have a reversable feature. This configuration includes an elongate cylindrical drum rotatably mounted about a horizontal longitudinal axis, at least one cutter extending outwardly from the surface of the drum, means for rotating the cylindrical drum about its longitudinal axis in a first direction such that the cutter follows a circular path, feed means for mounted rotation adjacent to the drum in a direction opposite to the first direction for feeding the wood into the path of the cutter, sensing means for sensing a predetermined level of power required to rotate the feed means, and reversing means responsive to the sensing means for reversing the rotational direction of the log.

Thus, it is an object of the present invention to provide an improved wood cutting member.

It is a further object of the present invention to provide a wood cutting member that penetrates into the wood with a reduced power requirement.

It is a further object of the present invention to provide a wood cutting member which produces a consistent wood chip product.

It is a further object of the present invention to provide a wood cutting member which is inexpensive to manufacture and install.

It is a further object of the present invention to provide a wood cutting member which is disposable.

It is a further object of the present invention to provide a wood cutting member which is subject to a minimum of damage when encountering unprocessable foreign material.

It is a further object of the present invention to provide a wood cutting member which may be used with stationary anvils on conventional wood hog machines.

It is a further object of the present invention to provide an improved wood processing apparatus to operate in combination with the improved wood cutting member.

It is a further object of the present invention to provide an improved manner in which to mount a wood cutting member on a supporting disc or drum.

It is a further object of the present invention to provide a wood processing apparatus which provides a processed product having a consistent size.

It is a further object of the present invention to provide an improved wood chip separating grate.

Other objects, features, and advantages of the present invention will become apparent upon review of the following detailed description of embodiments of the invention, when taken in conjunction with the drawings

DETAILED DESCRIPTION

Figure 1:
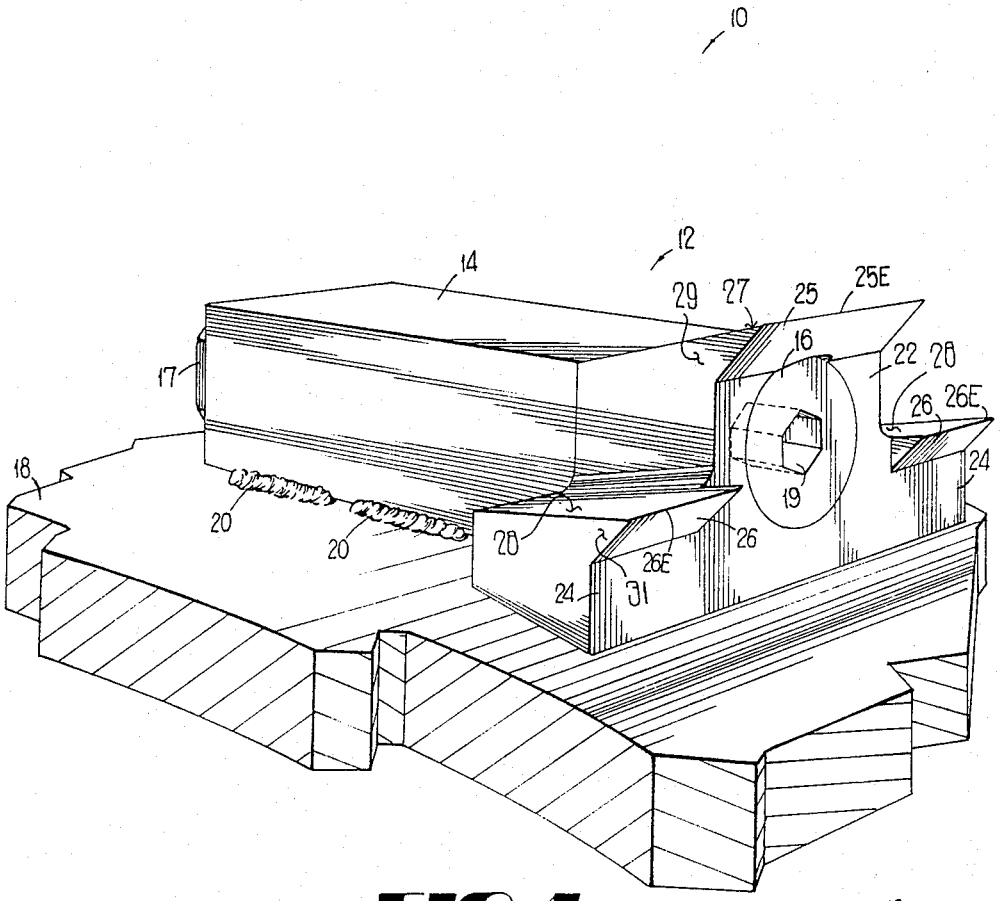
FIG. 1 is a pictorial view of the winged hammer of the present invention as attached to a typical mounting surface, shown in cutaway.
Figure 2:
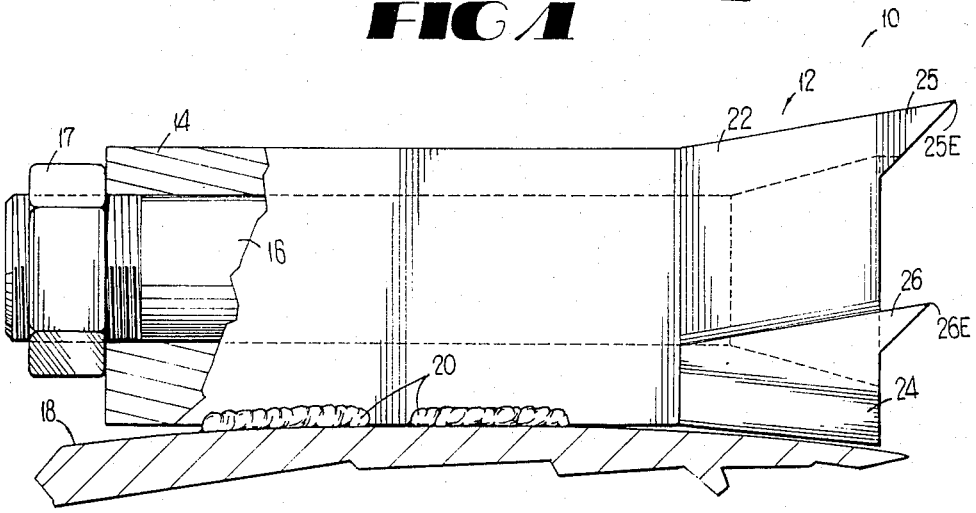
FIG. 2 is a side partial cutaway view of the winged hammer of FIG. 2.

Referring now to the drawings, in which like numerals represent like parts throughout the several views, FIGS. 1 and 2 show a winged hammer assembly 10 embodying the present invention. The winged hammer assembly 10 includes a cutting head 12, a body 14, a mounting screw 16, and a nut 17. As will be discussed further in this application, the body 14 is fixed to a typical mounting surface 18 by weldments 20, or other fastening means known in the art.

Referring now to FIGS. 1 and 2, the body 14 of the winged hammer assembly 10 is an elongate rectangular member and is rigidly affixed to the mounting surface 18 by a plurality of weldments 20. The weldments 20 are preferably small beads lying along the intersection of the body 14 with the mounting surface 18. As discussed later in this application, the weldments 20 are configured such that the body 14 of the winged hammer assembly 10 may break away from the mounting surface 18 during overstressful operation of the winged hammer assembly.

The cutting head 12 is attached to the body 14 by the mounting screw 16, which passes through the center of the cutting head and is captured behind the body by a nut 17. The head of the mounting screw 16 defines a hex key cavity 19.

The cutting head 12 is of a unitary construction and includes a central cutting member 22, and two wing members 24 extending to each side of the central cutting member The central cutting member 22 and the wing members 24 define a central knife 25, and similarly shaped wing knives 26, respectively. When the cutting head 12 is in mounted position, it may be seen that the central knife 25 and wing knives 26 are directed in a common direction away from the body member. As shown in FIG. 1, it may also be seen that the central knife 25 and wing knives 26 include upper heel surfaces 27, 28, respectively, and side heel surfaces 29, 31, respectively The central knife 25 or the wing knives 26 may be treated with a hardening powder (not shown) to prolong the cutting life of the cutting head.

Figure 6:
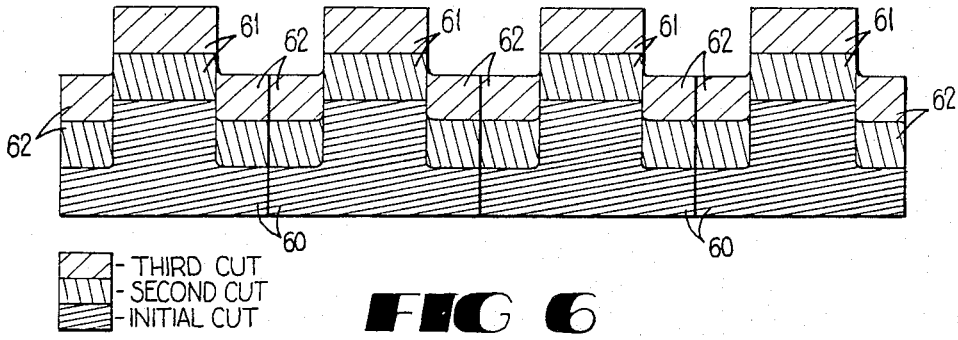
FIG. 6 is a diagrammatic representation of the cutting process as the winged hammers pass through the wood members.

Referring also now to FIGS. 1 and 2, it may be seen that the cutting edge 25E of the central knife 25 projects away from the mounting surface 18 approximately twice the distance than the cutting edges 26E of the wing knives 26, although other configurations may be used which fall within the spirit and scope of the present invention. Furthermore, it may be seen that the cutting edges are the forwardmost elements of the hammer assembly 10 when in mounted position, and are the first portion of the cutting head 12 to engage the wood members as discussed later in this application. Referring now to FIG. 6, it may be seen that the cutting head is configured to cut a cavity which is substantially the shape of an inverted "T" relative to the mounting surface 18.

Figure 3:
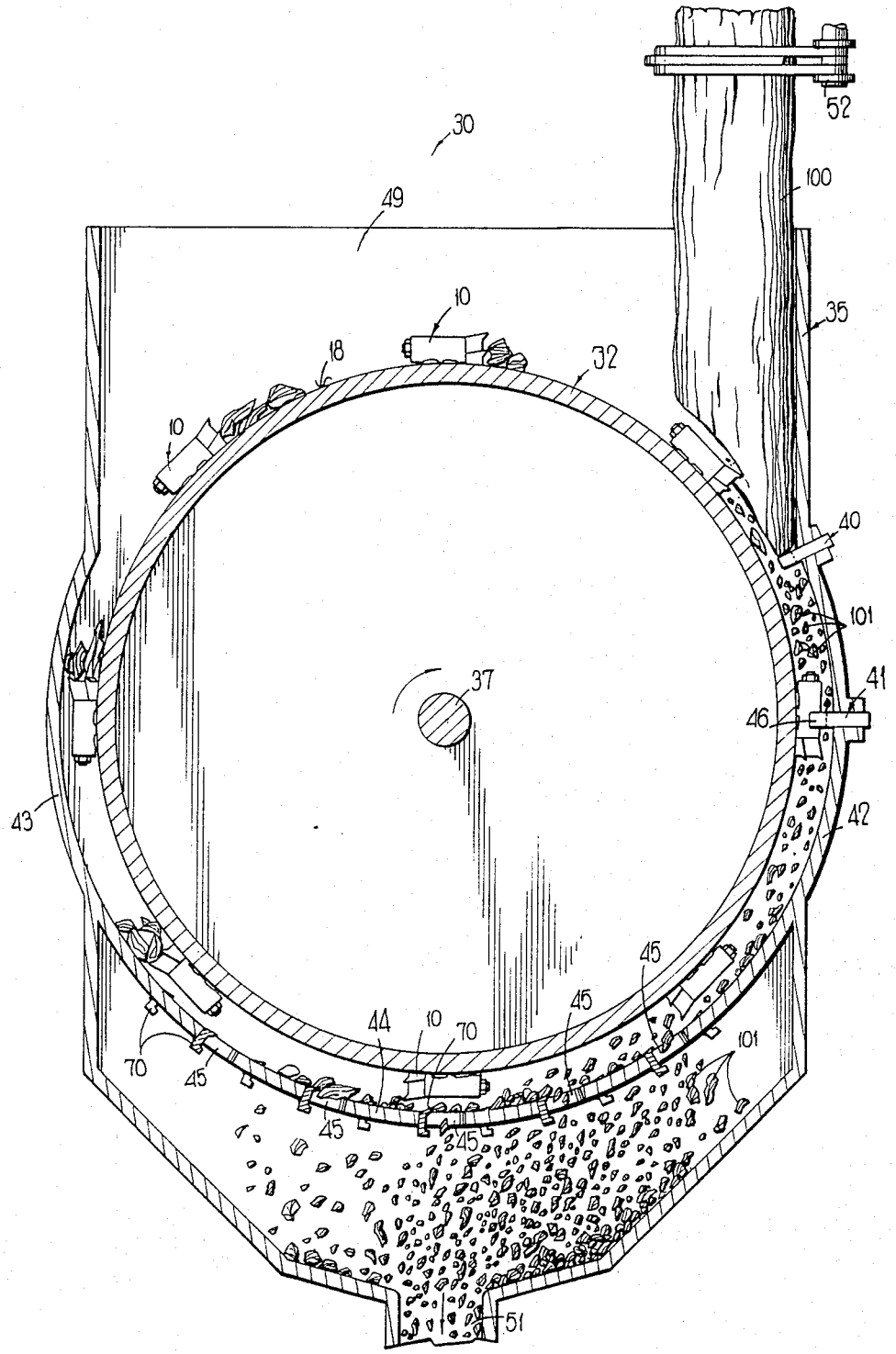
FIG. 3 is a side cross sectional view of the rotating drum assembly which supports the winged hammer of FIG. 1.
Figure 4:
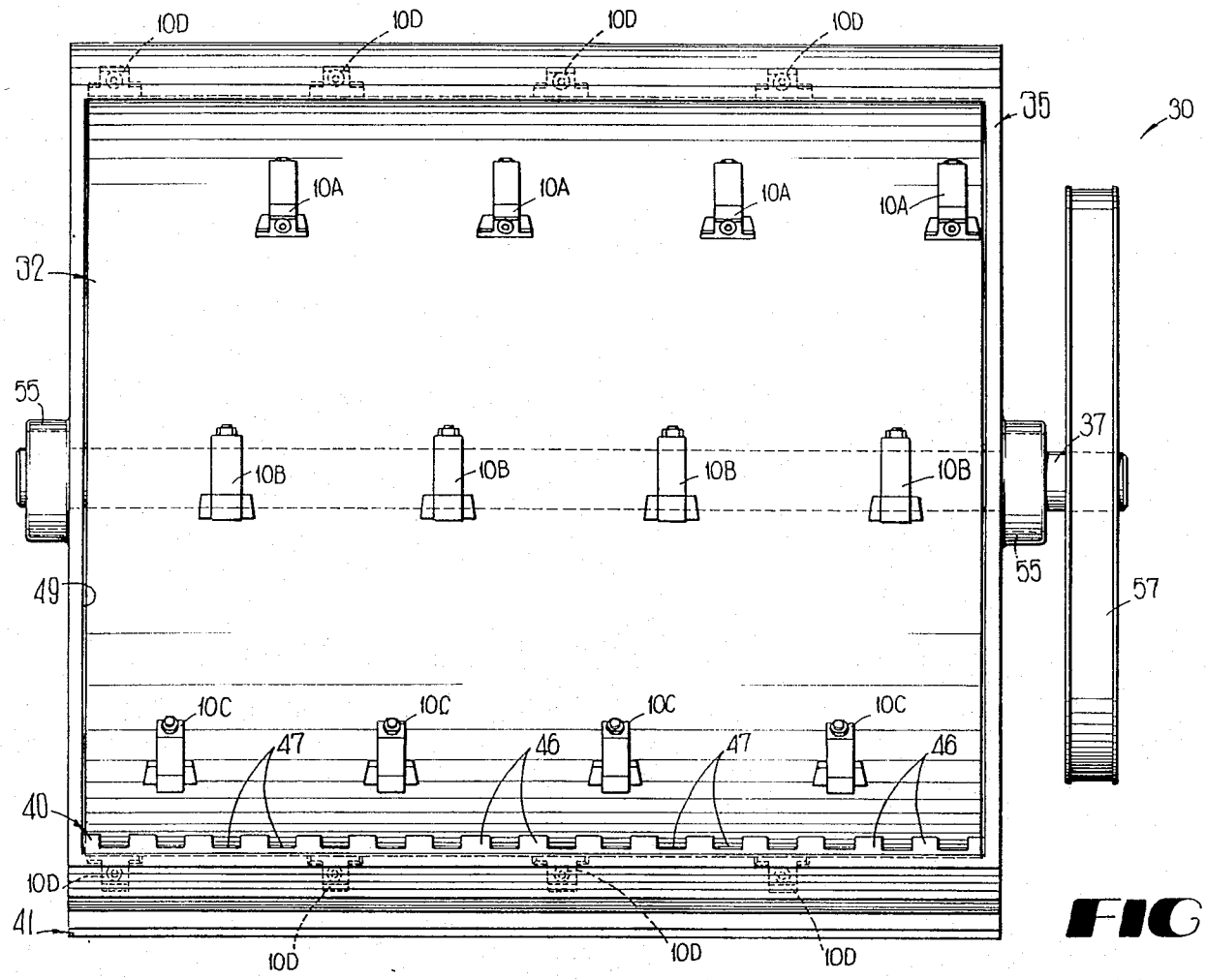
FIG. 4 is a top partial cutaway view of the rotating drum assembly of FIG. 3.

Referring now to FIG. 3, the winged hammer assembly 10 of the present invention may be used in combination with a rotating drum assembly 30. The drum assembly 30 includes a cylindrical rotating drum 32 which defines the previously-discussed mounting surface 18, a frame 35, a central rotating shaft 37, upper and lower toothed anvil members 40, 41, respectively, first and second wood chip guides 42, 43, a separating grate 44, an inlet hopper 49, and an outlet port 51. As shown in FIG. 4, the rotating drum assembly 30 also includes bearings 55, and a flywheel pulley 57.

Referring now to FIGS. 3 and 4, the rotating drum 32 is rigidly affixed to the rotating shaft 37 by welding or other means known in the art, such that the longitudinal axes of the shaft and the drum are substantially common, and the ends of the shaft protrude from the ends of the rotating drum 32. The ends of the shaft 37 are rotatably mounted within the bearings 55, which are rigidly mounted within the frame 35. Therefore it may be seen that the rotating drum 32 is rotatably mounted within the frame 35 along the longitudinal axis of the rotating shaft 37.

An input hopper 49 is provided above the rotating drum 32 and accepts the wood products 100 to be processed by the rotating drum assembly 30. Referring now to FIGS. 3 and 4, the wood members 100 may be inserted into the inlet hopper 49 by hand, if suitably sized, or larger wood members may be inserted into the inlet hopper 49 by bulldozers or front-end loaders (not shown). If an exceptionally long wood member, such as a large tree, is to be inserted into the inlet hopper 49, this may be done by use of a grappler 52, which can grapple one end of a long wood member and feed the free end into the inlet hopper 49 to be consumed by the rotating drum assembly 30. Long wood members may also be inserted into the inlet hopper 49 by attaching one end of a chain or wire rope (not shown) to one end of the wood member, attaching the other end of the chain or wire rope to the bucket of an end loader, and slowly lowering the free end of the wood member into the inlet hopper 49. When a sufficient length of the wood member has been consumed by the rotating drum assembly 30, the chain or wire rope may be removed, and the remainder of the wood member may then be dumped into the inlet hopper 49 to be completely consumed by the rotating drum assembly .

The hopper 49 is defined by the frame 35, which provides side walls, and the drum surface. Upper and lower toothed anvils 40, 41, respectively, are elongate, and are rigidly mounted to the frame 35 adjacent to the mounting surface of the rotating drum such that the longitudinal axes of the upper and lower anvils 40, 41, are parallel to the rotational axis of the rotating drum 32. The anvils comprise alternating rectangular teeth 46 and rectangular notches 47. The teeth extend radially toward the center of the rotating drum 32. As will be discussed later in this application, the hammer assemblies 10 pass through corresponding notches in the anvils during rotation of the rotating drum 32. The upper anvil 40 is positioned in a throat formed between the bottom of one of the hopper side walls and the surface of the drum to intercept wood being carried out of the hopper by rotation of the drum. The upper anvil 40 combines with the hammer assemblies 10 to perform the initial cutting of the wood members The lower anvil 41 is positioned beneath the upper anvil, and performs a secondary cutting process. The cutting processes are discussed in detail later in this application.

The first and second chip guides 42, 43, are rigidly attached to the frame 35 and positioned beneath the rotating drum 32. The separating grate 44 is rigidly attached to the frame 35 and is positioned beneath the rotating drum 32 intermediate the first and second chip guides 42, 43. Together, the chip guides form a concentric partial sleeve spaced apart from the rotating drum and communicating at both ends with the input hopper 49.

Referring now to FIG. 4, the winged hammer assemblies 10 are helically positioned upon the circumferential surface of the rotating drum 32. In the preferred embodiment, the hammer assemblies 10 are arranged in a plurality of rows running the length of the rotating drum, the rows being spaced apart around the periphery of the drum surface For the purpose of explaining the positions of the hammer assemblies on the surface of the rotating drum 32, each row of hammer assemblies will now be assigned a particular suffix, with one row being assigned as hammer assemblies 10A, another row as hammer assemblies 10B, and other rows 10C and 10D. Similarly, each element of the assemblies will now have a similar suffix, for example hammer assemblies 10A now include cutting heads 12A, bodies 14A, central cutting members 22A and wing members 24A. As the hammer assemblies interact with the lower anvil 41 in a manner similar to the upper anvil 40, only the upper anvil will now be discussed.

Figure 5:
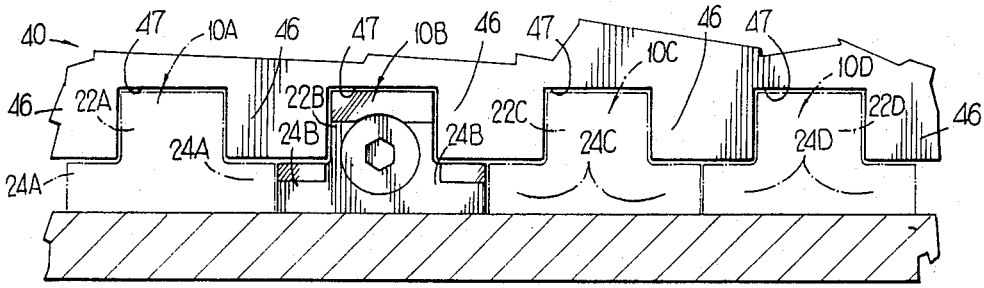
FIG. 5 is a partial cutaway view of the interaction of the winged hammers and the stationary anvils of the rotating drum assembly of FIG. 3.

Referring now to FIGS. 4 and 5, the row of hammer assemblies 10A interact intimately with spaced apart notches 47 during rotation of the drum 32. The central cutting members 22A pass through particular notches 47 during rotation of the drum, as the associated wing members 24A pass closely outside the teeth 46 of the upper anvil 40. As the drum rotates, the row of hammer assemblies 10B rotate in different radial planes from hammer assemblies 10A and interact with notches 47 which are adjacent to the notches through which hammer assemblies 10A passed. As the drum 32 continues to rotate, hammer assemblies 10C and 10D likewise pass through the remaining notches 47 in the upper anvil 40. Therefore it may be seen that after hammer assemblies 10A, 10B, 10C, and 10D have sequentially passed through the upper anvil, all of the notches 47 in the anvil have undergone interaction by one hammer assembly, and the drum has rotated approximately 180 degrees.

As shown in FIG. 3, the rows of hammer assemblies are evenly disposed about the circumferential surface of the rotating drum. Therefore it may be seen that a similar cutting process similar to the one just described occurs as the drum rotates another 180 degrees. It may also be seen that each notch 47 interacts with two different hammer assemblies during each rotation of the drum 32.

Referring now to FIGS. 3 and 4, the method of operation of the rotating drum assembly 30 with the winged hammer assemblies 10 is now discussed. A motor (not shown) drives a belt (not shown) which drives the flywheel pulley 57, thus rotating the center shaft 37 and the rotting drum 32. As the drum 32 is rotated, the hammer assemblies 10 intimately interact with the upper and lower anvils 40, 41, as previously discussed.

When wood members 100 are placed into the hopper, they contact the top of the rotating drum 32 and are drawn toward the stationary upper anvil 40. When the wood members encounter the upper anvil, the upper anvil prevents further movement of the wood members. Referring now also to FIG. 6, the cutting heads 12 of the hammer assemblies 10 then make a first pass through the wood members 100, removing a cross section similar to that previously discussed. As the cross section of wood is removed, the wood members drop down to the drum surface and are further consumed by succeeding cutting heads 12, until the wood members are eventually completely consumed.

As portions of the wood members 100 are cut away by the cutting heads and displaced through the upper anvil 40, they break up along the grain into the form of wood chips 101, and are drawn toward the lower anvil 41 by the hammer assemblies 10 and by the influence of gravity. As previously discussed, the hammer assemblies 10 interact with the lower anvil 41 as with the upper anvil 40. Therefore it may be seen that a similar cutting action is imparted to the wood chips 101 by the hammer assemblies 10 and the lower anvil 41, further pulverizing, shredding and breaking up the wood chips.

After passing the lower anvil 41, the wood chips 101 fall upon the first chip guide 42, and are drawn toward the separating grate 44 by the hammer assemblies 10 and by the influence of gravity. When the wood chips 101 contact the separating grate 44, chips small enough to pass through the separating grate do so and fall into the outlet port 51, and are then removed from the rotating drum assembly 30 by a conventional conveying means (not shown). The wood chips 101 too large to fall through the separating grate 44 are dragged across the top of the separating grate and along the second chip guide 43, and are then returned to the inlet hopper 49. These chips 101 are then subjected to another processing cycle until they are small enough to pass through the separating grate 44.

Figure 8:
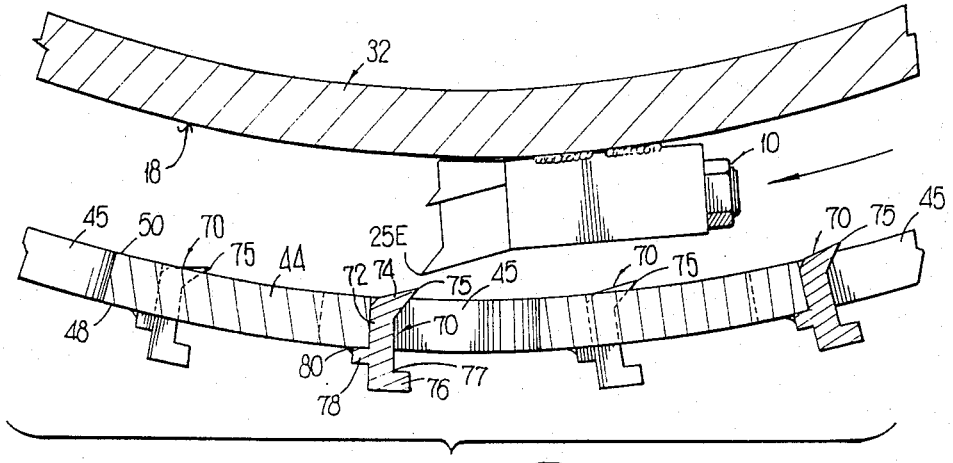
FIG. 8 is an isolated cutaway side view of FIG. 3, illustrating the interaction of the winged hammers and the grate.
Figure 9:
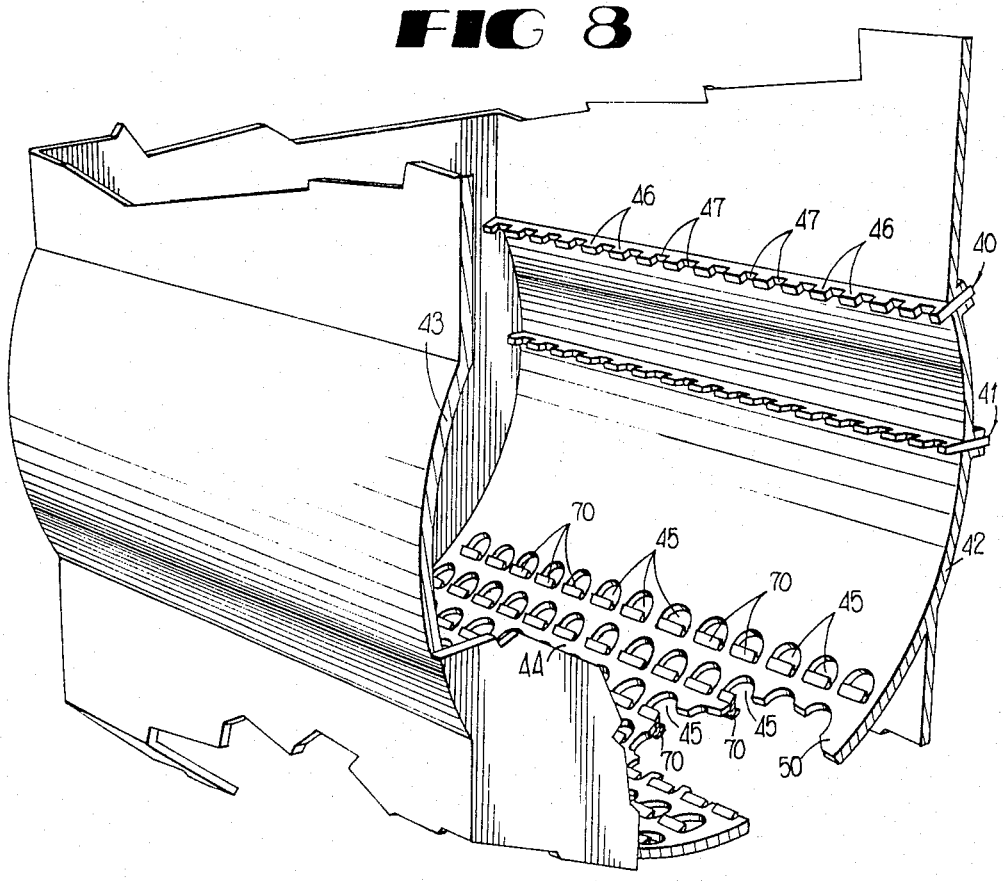
FIG. 9 is a partial pictorial view of the frame of the wood processing apparatus of FIG. 3, shown without the rotating drum to illustrate the grate and anvil members.

Referring now to FIGS. 8 and 9, the particular interaction of the hammer assemblies 10 and the separating grate 44 is now discussed. The separating grate 44 includes a plurality of D-shaped slots 45. As shown in FIG. 9, the D-shaped slots 45 are arranged in a series of spaced-apart rows with each row being substantially parallel to the rotating axis of the rotating drum, and the linear edges of the D-shaped slots 45 in each row being in substantial alignment, and also being on the "trailing" edge of the slot with respect to rotation of the rotating drum 32.

A grate knife 70 is positioned in a corresponding slot 45 against the trailing linear edge of the slot. It may be seen that the grate knife 70 includes a wall portion 72, a cutting portion 74 defining a cutting edge 75, a breakup ledge 76, and a positioning stop 78. It should be understood that the grate knives 70 have uniform cross sections as taken through a plane normal to the rotational axis of the rotating drum.

The wall portion 72 of the grate knife is substantially rectangular in cross section. When the grate knife 70 is installed, the wall portion 72 contacts the trailing wall of the D-shaped slot 45, and the primary planar surfaces of the wall portion extend substantially radially from the drum 32.

The cutting portion 74 is substantially wedge-shaped, extends from one corner of the inner edge of the wall portion, and converges to the cutting edge 75. When the grate knife 70 is installed, the cutting portion 74 extends inwardly toward the drum and away from the trailing edge of the corresponding D-shaped slot, and the cutting edge 75 is substantially parallel to the rotational axis of the rotating drum 32, and extends on the drum side surface 50 of the separating grate 44.

The breakup ledge 76 extends at a right angle from the end of the wall portion 72 on the same side as the cutting portion 74, and combines with the wall portion to define a corner 77. When the grate knife 70 is installed, the breakup ledge 76 extends outside of and tangentially away from the separating grate 44.

The positioning stop 78 extends away from the wall portion 72 at a right angle on the opposite side of the wall portion from the breakup ledge 76. The positioning stop 78 is positioned along the wall portion 72 such that during installation of the grate knife 70, the positioning stop 78 contacts the outer surface 48 of the separating grate 44, and the cutting edge 75 and breakup ledge 76 are thereby positively positioned relative to the separating grate 44 as previously described. The grate knife 70 is then rigidly secured to the grate 44 by a weldment 80, although other securing means may be used such as threaded fasteners, rivets, or glue.

Interaction of the separating grate 44 and a hammer assembly 10 is now discussed As the hammer assembly 10 rotates relative to the separating grate 44 and attached grate knives 70 as indicated by the arrow in FIG. 8, it may be seen that the cutting edge 25E of the, hammer assembly 10 passes closely alongside the cutting edge 75 of the grate knives 74. A passing distance of one-eighth of an inch is suggested between the two cutting edges, although other distances may be used without departing from the spirit and scope of the present invention. As the hammer assemblies 10 pass by the grate knives 70, it may be seen that wood members (not shown) may be caught between the grate knives 70 and the hammer assemblies 10, and cut by the cutting edges 75, 25E, respectively, thus supplementing the previously-discussed processing done by the hammer assemblies and the upper and lower anvils 40, 41, respectively As previously discussed, the configuration of prior art grates tended to allow excessively long wood members having an acceptable cross section to disadvantageously pass through their respective slots. Rubbing of the wood over the corners of the slots can rapidly round off the corners and make the grate less effective in breaking up the wood. However, it should be understood that the applicant's configuration significantly reduces this tendency. Should an excessively long wood member pass through one of the slots 45, it will tend to contact the breakup ledge 76 of a corresponding grate knife 70 and become jammed within the corner 77 of the grate knife. As the hammer assemblies continue to pass over the slot 45, it should be seen that an excessively long wood member would be bent over and broken or cut, thus reducing its length.

Referring now to FIG. 6, the particular manner in which the cutting heads pass through the wood members after the first pass is shown diagrammatically. As previously discussed, the cutting heads 12 of the hammer assemblies 10 remove a cross section 60 of wood similar to that of the cutting heads as the cutting heads make their first pass through the wood members. After this cut is made, the wood members, drop down under the influence of gravity to contact the surface of the drum 32. It may be seen that the distance which the wood member drops after each cut is approximately equal to the depth of cut of the wing members 24, since the wood members 100 contact the rotating drum on the portions of the wood members which have just been previously cut by the wing members. For wing members as described above having a ¾" height, the wood member drops about ¾". This movement of the wood also determines the depth of subsequent cuts of the central cutting members 22, which would cut ¾" in the preferred embodiment. By limiting the depth of cut, the power required to drive each cutting member through the wood members is also limited If a reasonable number of cutting members is placed in each row (such as four, shown in FIG. 4), the number of cutting members that can simultaneously engage the wood is limited, and the size of the drive motor can be limited correspondingly. However, production capacity need not be sacrificed, because the number of rows on the rotating drum can be increased. For example, six layers of wood could be removed in a single rotation of the rotating drum. Because the cutter configuration and method of mounting is so inexpensive and uncomplicated, many more cutters can be economically and selectively installed on a drum than was the case with conventional wood processing machines A 48 inch drum configured as shown in FIG. 4 which makes two cuts per revolution, can be operated with a 400 horsepower engine. The same drum carrying half as many knives and making one cut per revolution could be operated with a 200 horsepower engine When another hammer comes along in the same radial plane aligned to pass through the same notch in the anvil as the first hammer, the second hammer removes three separate rectangular cross sections the central cutting member 22 removes a rectangular cross section 61 representing a depth of cut equal to the height of the wing members, and each of the two wing members remove a cross section 62 similar to their cross sections Therefore it may be seen that the unique cross section of the cutting heads allows for removal of three separate cross sections of wood for each pass of each cutting head through the wood members.

As previously discussed, the hammer assemblies 10 are affixed to the surface of the rotating drum 32 by weldments 20. These weldments 20 are configured such that if a piece of unprocessable material such as metal is encountered by a particular hammer assembly 10, the weldments 20 associated with that hammer assembly 10 are torn away, thus allowing the hammer assembly to break away from the drum, and allowing the drum to continue rotation without damage to more expensive elements of the machine, such as the rotating shaft or motor.

In the event that a hammer assembly 10 breaks away from the surface of the rotating drum 32 as previously described, the cutting process is terminated by the machine operator. A replacement weldement 20 is then provided to replace the hammer assembly 10. If the hammer assembly is damaged, a replacement is provided. Providing such replacement weldments and hammer assemblies is a relatively simple and inexpensive process, especially in comparison to such alternatives as replacing a drive shaft or motor.

After processing of wood for a time by the rotating drum assembly 30, the cutting edges of the cutting head 12 become dull. The lifetime of the cutting edges depends upon the nature of the material being cut, and whether it includes soil, sand or debris with the wood. Dulling of the edges decreases the efficiency of the rotating drum assembly 30, as more power is required to drive the cutting heads 12 through the wood members. In this event, the rotating drum assembly 30 is turned off, and the dull cutting heads are removed and replaced with new cutting heads by simply removing the bolt 17 and mounting screw 16, removing the dull cutting head, and securing a new cutting head in its place. If desired, the cutting edges of the dull cutting heads may then be resharpened. However, because of the manner in which the relatively small and simple cutting head 12 is attached to the body 14, the applicant has found that it is more economically advantageous to fabricate new cutting heads instead of sharpening dull cutting heads, and therefore the cutting heads can be treated as a disposable item.

Figure 7:
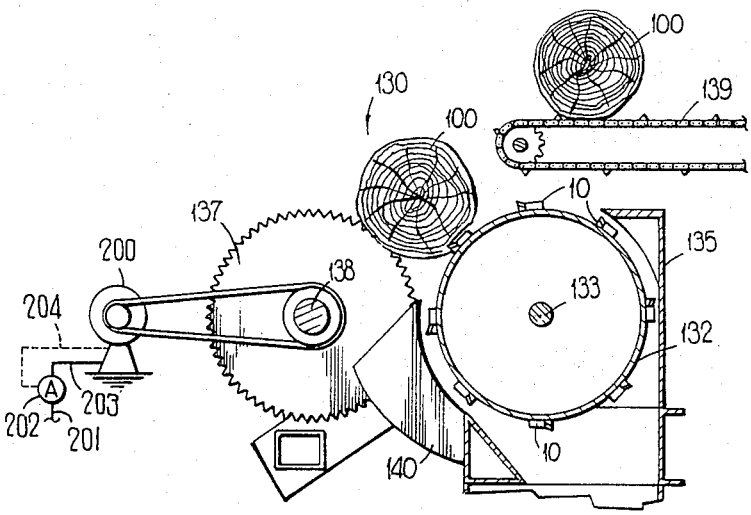
FIG. 7 is a cross sectional view of an alternative rotating drum embodiment which supports the winged hammer of FIG. 1.

The cutting assemblies may be mounted onto various existing apparatus. The apparatus 130 shown in FIG. 7 is similar to that of the apparatus disclosed in U.S. Pat. No. 4,444,234, which is expressly incorporated herein by reference in its entirety. A rotating drum 132 which supports the winged hammer assemblies is rigidly mounted upon a shaft 133 rotatably mounted to a frame 135. A set of toothed support rollers 137 are rigidly mounted to a second shaft 138, which is also rotatably mounted to the frame 135. The longitudinal axes of the two shafts are substantially parallel. During operation of the apparatus, to process brush and the like, the toothed support rollers 137 are rotated clockwise relative to the viewer to force feed the material toward the drum 132, and the drum 132 rotates counterclockwise. The hammer assemblies 10 on the drum 132 cut through the wood being forced toward the drum by the rollers 137.

Alternately, the apparatus 130 may be operated to process large wood members such as logs in the manner described in U.S. Pat. No. 4,444,234. A wood supply conveyor 139 supplies wood members 100 into a "cradle" formed by the drum 132 and the toothed support rollers 137, such that the longitudinal axis of the wood member is substantially parallel to the rotational axes of the toothed support rollers and the drum. As the drum 132 and the toothed support rollers 137 rotate, the wood member rotates counterclockwise, and is cut about its outer circumferential surface by the hammer assemblies. As the wood member is continuously rotating relative to the drum, it should be understood that the horsepower requirements are minimized by minimizing the length of cut made by the hammer assemblies 10 extending from the drum. This cutting process may continued until the wood member 100 is completely consumed, or may be terminated when a desired rounding of the wood members is achieved, upon which the toothed support rollers 137 pivot downwardly relative to the drum, and guide plates 140 guide the wood members downwardly and away from the drum.

Should at any time the power requirements for driving the apparatus 130 in the force feed configuration become excessive, the rotational direction of the second shaft 138 (and attached toothed support rollers) may be switched and reversed. This reversal may be done via conventional hydraulic control circuitry by a manual operator, or may be done in response to a load-indicating signal associated with the power source, such as a tachometer in the case of a combustion engine, or an ammeter in the case of an electric motor.

For example, as shown in FIG. 7, an ammeter 202 may be placed in line to the power supply line 201 of an electric motor 200, which drives the support rollers 137. A control line 204 carries a control signal as known in the art from the ammeter 204 to controls of the motor 200, such that when the ammeter 202 reads a particular preselected amperage value, a control signal is sent via line 204 to the controls of the motor 200 such that its directed is reversed.

Although FIG. 7 discloses the use of toothed support rollers 137 in combination with the drum 132, it should be understood that any roller means may be used which rotate the logs relative to the drum 132 as previously described. For example, a drum having radially protruding spikes could be used in place of the support rollers 137. Similarly, a series of direction rollers could be provided which could be mounted to a shaft similar to the toothed support rollers 137, except that the disk-like rollers could be provided with staggered notches about their periphery, configured to engage the wood members similar to the teeth in the toothed rollers 137.

Although the use of the hammer assemblies has been disclosed only in combination with a drum-shaped supporting apparatus, it should be understood that a rotating disc configuration of the type shown in U.S. Pat. No. 4,569,380, now expressly incorporated by reference, could also be used to support the hammer assemblies. Such a configuration could include a disc mounted on a rotating shaft which is driven in a manner similar to that of the rotating drum assembly. The hammer assemblies could be mounted by break-away weldments to the disc, as replacements for traditional knives. If desired, anvils could be positioned relative to the hammer assemblies such that the hammer assemblies pass in intimate relation to the anvils during rotation of the disc. The hammer assemblies could also be used in a counterrotating dual drum configuration, with the hammer assemblies being mounted on one drum and cooperating with pockets defined by the second drum.

Therefore it may be seen that the present invention provides a novel and improved wood cutting member which facilitates power-efficient cutting and shredding of wood products. The present invention also provides a wood processing machine which is subject to a minimum of damage when encountering unprocessable foreign material. Additionally, the present invention provides a chip filtering grate which provides improved wood chip processing and filtering, resulting in a consistently sized wood chip or fuel product.

While this invention has been described in detail with reference to preferred embodiments thereof, it will be understood that variations and modifications can be made within the spirit and scope of the invention as described here and above as defined in the appended claims.

I claim:

1. A wood processing apparatus comprising: an elongate cylindrical drum rotatably mounted about a horizontal longitudinal axis;

at least one cutter extending outwardly from the surface of said drum means for rotating said cylindrical drum about its longitudinal axis in a first direction such that said cutter follows a circular path;

feed means for mounted rotation adjacent to said drum in a direction opposite to said first direction for feeding said wood into said path of said cutter;

sensing means for sensing a predetermined level of power required to rotate said feed means; and reversing means responsive to said sensing means for reversing the rotational direction of said feed means.

2. A log processing apparatus comprising: an elongate cylindrical drum rotatably mounted about a horizontal longitudinal axis;

at least one cutter extending outwardly from the surface of said drum;

means for rotating said cylindrical drum about its longitudinal axis in a first direction;

roller means positioned beside said drum such that the periphery of said roller means is positioned closely adjacent to the surface of said drum, said roller peripheries and said drum supporting said log and defining a log-receiving cradle therebetween;

means for rotating said roller means so as to rotate said log in said first direction; and means for sensing a predetermined level of power required by said rotating means and reversing the rotational direction of said log.

* * * * *